US005955948A

United States Patent [19]

Howell

[11] Patent Number: 5,955,948

[45] Date of Patent: Sep. 21, 1999

[54] PURSE ALARM

[76] Inventor: Willie E. Howell, 1139 Mulberry St., Rockford, Ill. 61101

[21] Appl. No.: 08/878,646

[22] Filed: Jun. 19, 1997

[51] Int. Cl.[6] ..... G08B 13/14

[52] U.S. Cl. ..... 340/568.7; 340/571; 340/574; 150/101

[58] Field of Search ..... 340/309.15, 572, 340/571, 574, 573, 568, 546; 150/101, 102

[56] References Cited

U.S. PATENT DOCUMENTS

| | | | |
|---|---|---|---|
| D. 339,542 | 9/1993 | Lorton | D10/104 |
| D. 343,060 | 1/1994 | Diaz et al. | D3/36 |
| 3,701,140 | 10/1972 | Dixon | 340/571 |
| 3,851,326 | 11/1974 | Costa | 340/571 |
| 4,376,935 | 3/1983 | Castaldo | 340/571 |
| 4,394,644 | 7/1983 | Di Leo et al. | 340/571 |
| 4,633,232 | 12/1986 | Nelson et al. | 340/571 |
| 4,755,802 | 7/1988 | Urbanczyk | 340/571 |
| 4,780,704 | 10/1988 | Tommasini | 340/572 |
| 4,885,570 | 12/1989 | Chien | 340/571 |
| 5,053,749 | 10/1991 | Weiss | 340/568 |
| 5,164,706 | 11/1992 | Chen | 340/571 |
| 5,175,868 | 12/1992 | Yasuoka | 340/572 |
| 5,281,953 | 1/1994 | Torres et al. | 340/571 |
| 5,337,041 | 8/1994 | Friedman | 340/573 |
| 5,396,219 | 3/1995 | Chen | 340/571 |
| 5,412,373 | 5/1995 | Wajda | 340/571 |

*Primary Examiner*—Nina Tong

[57] ABSTRACT

A PURSE ALARM is provided including a purse and a switch for providing an activation signal upon the opening thereof. A purse alarm module is situated the purse and includes a purse state mechanism in communication with the switch. The purse state mechanism is adapted to continuously transmit the activation signal upon the instantaneous receipt thereof. A purse transmitter is connected to the purse state mechanism for transmitting the activation signal via free space upon the receipt thereof. Further included is a portable remote with a remote receiver adapted to receive the activation signal via free space and a remote alarm means for emitting an audible alarm during the receipt of the activation signal. Also included is a remote state mechanism connected between the remote receiver and the remote alarm. The remote state mechanism is adapted to continuously transmit the activation signal to the remote alarm upon the instantaneous receipt thereof from the remote receiver thereby actuating the remote alarm upon the opening of the purse.

5 Claims, 2 Drawing Sheets

PURSE ALARM

BACKGROUND OF THE INVENTION

1. Field of the Invention

The present invention relates to purse alarms and more particularly pertains to a new PURSE ALARM for alerting a user of the infiltration of a purse thereof.

2. Description of the Prior Art

The use of purse alarms is known in the prior art. More specifically, purse alarms heretofore devised and utilized are known to consist basically of familiar, expected and obvious structural configurations, notwithstanding the myriad of designs encompassed by the crowded prior art which have been developed for the fulfillment of countless objectives and requirements.

Known prior art purse alarms include U.S. Pat. Nos. 5,164,706; 4,755,802; 4,394,644; Des. 343,060; 5,396,219; and 5,412,373.

In these respects, the PURSE ALARM according to the present invention substantially departs from the conventional concepts and designs of the prior art, and in so doing provides an apparatus primarily developed for the purpose of for alerting a user of the infiltration of a purse thereof.

SUMMARY OF THE INVENTION

In view of the foregoing disadvantages inherent in the known types of purse alarms now present in the prior art, the present invention provides a new PURSE ALARM construction wherein the same can be utilized for alerting a user of the infiltration of a purse thereof.

The general purpose of the present invention, which will be described subsequently in greater detail, is to provide a new PURSE ALARM apparatus and method which has many of the advantages of the purse alarms mentioned heretofore and many novel features that result in a new PURSE ALARM which is not anticipated, rendered obvious, suggested, or even implied by any of the prior art purse alarms, either alone or in any combination thereof.

To attain this, the present invention generally comprises a flexible purse having a bottom face with a pair of side faces and a pair of end faces integrally coupled thereto and extending upwardly therefrom. Such structure thus defines an interior space with an open top. The purse further includes a pair of rigid hollow rods coupled along an upper edge of the side faces. Note FIG. 1. Each of such hollow rods are equipped with a pair of snaps situated thereon for allowing the selective closure of the top opening. Also included is a handle assembly with a pair of inverted U-shaped straps each coupled to ends of an associated one of the end faces. A primary strap is provided having ends slidably coupled to the inverted U-shaped straps. Situated within the hollow rods is a magnetic switch. In use, the magnetic switch is adapted for providing an activation signal upon the separation of the hollow rods and opening of the purse. Further included is a purse alarm module situated within a housing. Note FIGS. 1 & 3. Such housing is positioned in the interior space of the purse and includes a purse state means adapted to continuously transmit the activation signal upon the instantaneous receipt thereof until the receipt of a clear signal. Connected between the magnetic switch and the purse state means is a delay means. The delay means is adapted for transmitting the activation signal to the purse state means after a predetermined time from the receipt thereof from the magnetic switch. The purse alarm module further includes a purse receiver means connected to the state means for transmitting a clear signal upon the receipt thereof via free space. A purse alarm means resides in communication with the purse state means and is adapted to emit an audible alarm during the receipt of the activation signal. A discrete silent switch is positioned on the housing of the purse alarm module and connected between the purse state means and the purse alarm means. In use, the discrete silent switch is capable of selectively precluding the transmission of the activation signal to the purse alarm means for disabling the same. Lastly, a purse transmitter means is connected to the purse state means for transmitting the activation signal via free space upon the receipt thereof. As shown in FIGS. 2 & 4, a portable remote module is provided having a rectangular configuration with an eyelet formed on a periphery thereof. The eyelet is included for coupling with a key ring. The remote module includes a remote receiver means which is adapted to receive the activation signal via free space. Also included is a remote alarm means for emitting an audible alarm during the receipt of the activation signal. Connected between the remote receiver means and the remote alarm means is a remote state means. The remote state means is adapted to continuously transmit the activation signal to the remote alarm means upon the instantaneous receipt thereof from the remote receiver means. This actuates the remote alarm means upon the opening of the purse until the receipt of the clear signal. Further provided is a reset button situated on the remote module. The reset button is connected to the remote state means for transmitting the clear signal thereto upon the depression thereof thereby deactivating the remote alarm means. Finally, a remote transmitter means is connected to the reset button for transmitting the clear signal via free space upon the receipt thereof thereby deactivating the purse alarm means.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new PURSE ALARM apparatus and method which has many of the advantages of the purse alarms mentioned heretofore and many novel features that result in a new PURSE ALARM which is not anticipated, rendered obvious, suggested, or even implied by any of the prior art purse alarms, either alone or in any combination thereof.

It is another object of the present invention to provide a new PURSE ALARM which may be easily and efficiently manufactured and marketed.

It is a further object of the present invention to provide a new PURSE ALARM which is of a durable and reliable construction.

An even further object of the present invention is to provide a new PURSE ALARM which is susceptible of a low cost of manufacture with regard to both materials and labor, and which accordingly is then susceptible of low prices of sale to the consuming public, thereby making such PURSE ALARM economically available to the buying public.

Still yet another object of the present invention is to provide a new PURSE ALARM which provides in the apparatuses and methods of the prior art some of the advantages thereof, while simultaneously overcoming some of the disadvantages normally associated therewith.

Still another object of the present invention is to provide a new PURSE ALARM for alerting a user of the infiltration of a purse thereof.

Even still another object of the present invention is to provide a new PURSE ALARM that includes a purse and a switch for providing an activation signal upon the opening thereof. A purse alarm module is situated the purse and includes a purse state mechanism in communication with the switch. The purse state mechanism is adapted to continuously transmit the activation signal upon the instantaneous receipt thereof. A purse transmitter is connected to the purse state mechanism for transmitting the activation signal via free space upon the receipt thereof. Further included is a portable remote with a remote receiver adapted to receive the activation signal via free space and a remote alarm means for emitting an audible alarm during the receipt of the activation signal. Also included is a remote state mechanism connected between the remote receiver and the remote alarm. The remote state mechanism is adapted to continuously transmit the activation signal to the remote alarm upon the instantaneous receipt thereof from the remote receiver thereby actuating the remote alarm upon the opening of the purse.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
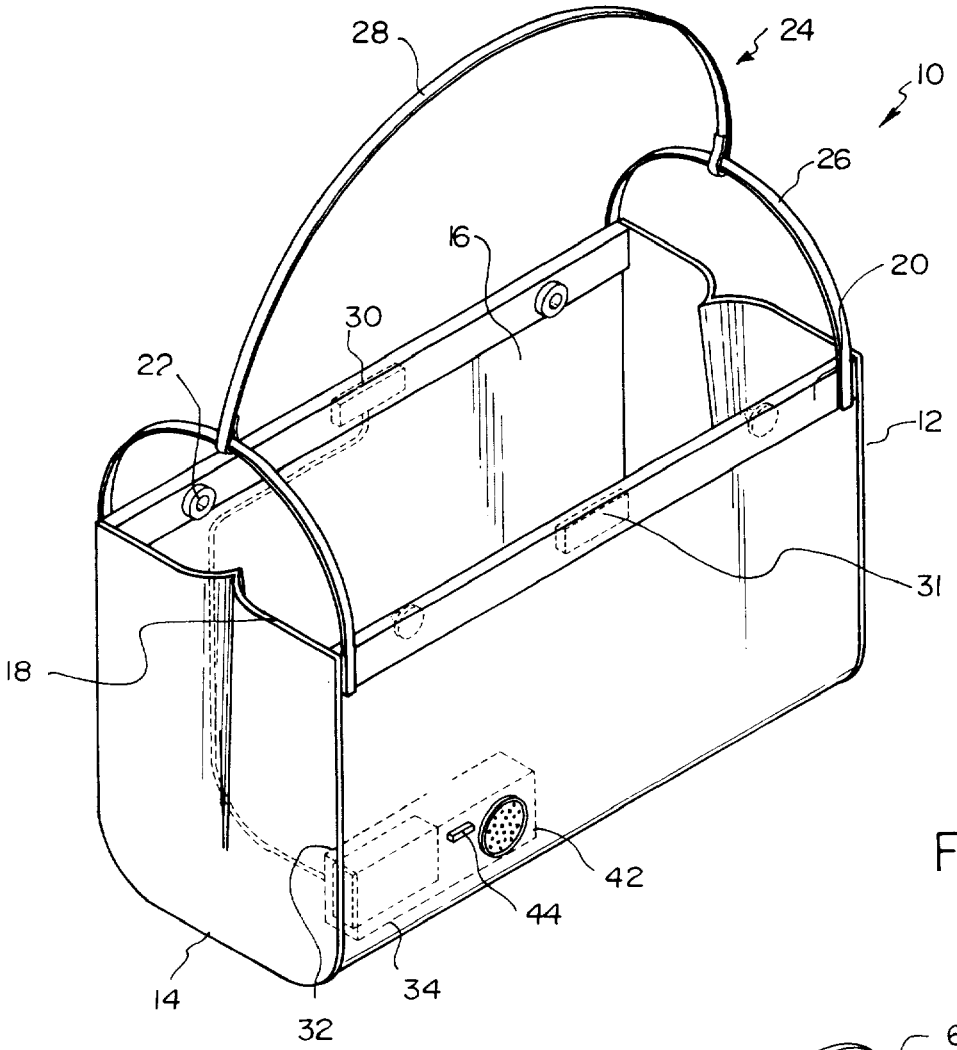
FIG. 1 is a perspective view of a new PURSE ALARM according to the present invention.

With reference now to the drawings, a new PURSE ALARM embodying the principles and concepts of the present invention and generally designated by the reference numeral 10 will be described.

The system 10 of the present invention includes a flexible purse 12 having a bottom face 14 with a pair of side faces 16 and a pair of end faces 18 integrally coupled thereto and extending upwardly therefrom. Such structure thus defines an interior space with an open top. The purse further includes a pair of rigid hollow rods 20 coupled along an upper edge of the side faces. Note FIG. 1. Each of such hollow rods is equipped with a pair of snaps 22 situated thereon for allowing the selective closure of the top opening. Also included is a handle assembly 24 with a pair of inverted U-shaped straps 26 each coupled to ends of an associated one of the end faces. A primary strap 28 is provided having ends slidably coupled to the inverted U-shaped straps.

Situated within the hollow rods is a magnetic switch 30 with an associated magnet 31. In use, the magnetic switch is adapted for providing an activation signal upon the separation of the hollow rods and opening of the purse. It should be noted that the magnetic switch is similar to switches of the reed switch art and are commonly known and commercially available.

Further included is a purse alarm module 32 situated within a housing 34. Note FIGS. 1 & 3. Such housing is positioned within the interior space of the purse on the bottom face thereof. The alarm module includes a purse state means 36 adapted to continuously transmit the activation signal upon the instantaneous receipt thereof until the receipt of a clear signal. Connected between the magnetic switch and the purse state means is a delay means 38. The delay means is adapted for transmitting the activation signal to the purse state means only after receiving the activation signal for a predetermined time from the magnetic switch. The purse alarm module further includes a purse receiver means 40 connected to the state means for transmitting a clear signal thereto upon the receipt thereof via free space. A purse alarm means 42 also resides in communication with the purse state means and is adapted to emit an audible alarm during the receipt of the activation signal. A discrete silent switch 44 is positioned on the housing of the purse alarm module and connected between the purse state means and the purse alarm means. In use, the discrete silent switch is capable of selectively precluding the transmission of the activation signal to the purse alarm means for disabling the same. Preferably, the silent switch comprises a push button switch. Lastly, a purse transmitter means 46 is connected to the purse state means for transmitting the activation signal via free space upon the receipt thereof.

Figure 3:
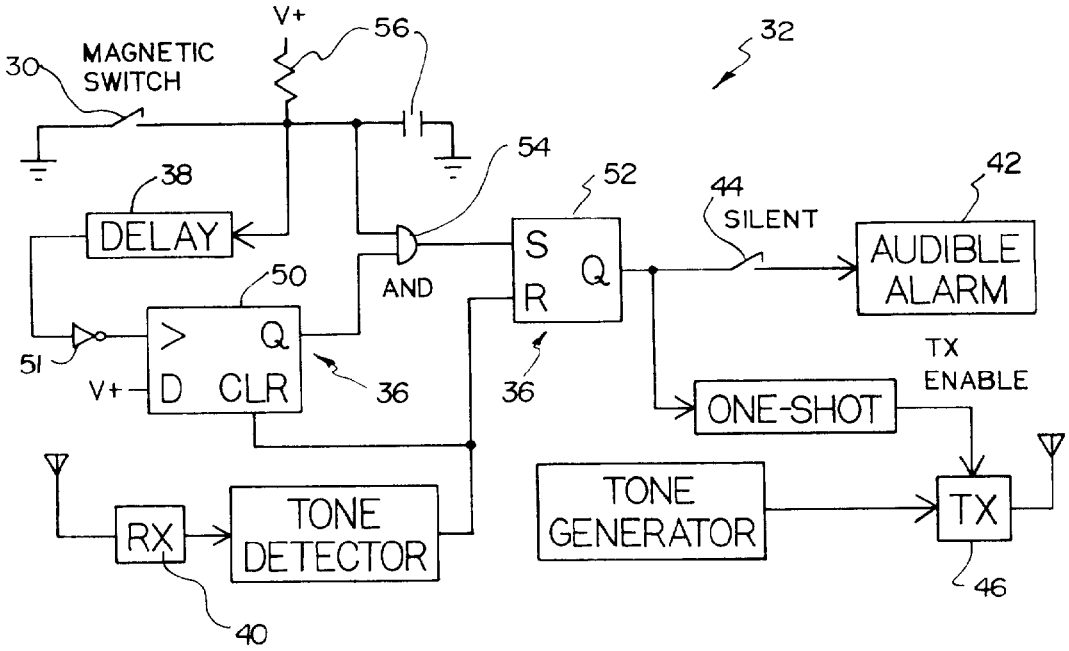
FIG. 3 is a schematic diagram of the purse alarm module of the present invention.

As shown in FIG. 3, the purse state means includes a D-flip flop 50 having an input connected to the delay means. An inverter 51 is coupled to the input the of D-flip flop. Connected to a clear input of the D-flip flop is the purse receiver means. The purse state means further includes a SR-latch 52 with a reset input thereof connected to the purse receiver means and a set input connected to an output of the D-flip flop with an AND gate 54 coupled therebetween. Another one of the inputs of the AND gate is coupled to an RC network 56 which is in turn connected to the magnetic switch.

Figure 2:
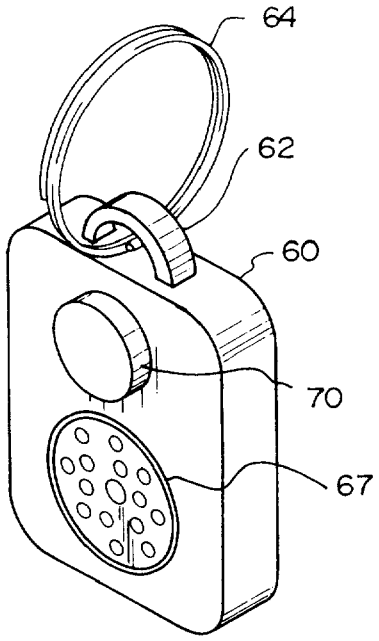
FIG. 2 is a perspective view of the portable remote module of the present invention.
Figure 4:
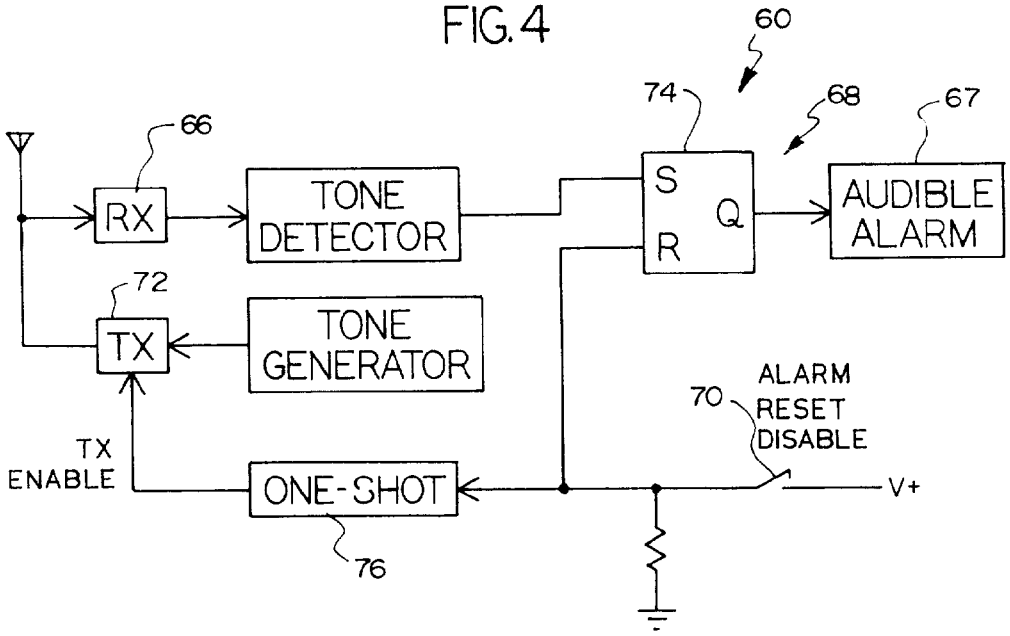
FIG. 4 is a schematic diagram of the portable remote module of the present invention.

As shown in FIGS. 2 & 4, a portable remote module 60 is provided having a rectangular configuration with an eyelet 62 formed on a periphery thereof. The eyelet is included for coupling with a key ring 64. The remote module includes a remote receiver means 66 which is adapted to receive the activation signal via free space. Also included is a remote alarm means 67 for emitting an audible alarm during the receipt of the activation signal. Connected between the remote receiver means and the remote alarm means is a remote state means 68. The remote state means is adapted to continuously transmit the activation signal to the remote alarm means upon the instantaneous receipt thereof from the remote receiver means. This actuates the remote alarm means upon the opening of the purse until the receipt of the clear signal. Further provided is a reset button 70 situated on the remote module. The reset button is connected to the remote state means for transmitting the clear signal thereto upon the depression thereof thereby deactivating the remote alarm means. Finally, a remote transmitter means 72 is connected to the reset button for transmitting the clear signal via free space upon the receipt thereof thereby deactivating the purse alarm means.

The remote state means preferably comprises a second SR-latch 74 with a set input connected to the remote receiver means and a reset input connected to the reset button. It should be noted that each of the transmitter means of the present invention is actuated by way of a one-shot multivibrator 76.

In use, when the purse is closed, the remote and purse alarm means will be armed after a predetermined delay of preferably about a few seconds. When the purse is opened, the alarm means emit their respective alarms. It should be noted that the purse alarm means will only actuate if the silent switch is not depressed. To deactuate and reset the alarm, the reset button of the remote module is depressed. In order to prevent the alarm means from actuating when the purse is opened, the reset button of the remote module must first be depressed. It should be further noted that the alarm is rearmed by the opening and closing of the purse.

In an alternate embodiment, the transmitter of the purse is adapted to continuously transmit a remote signal and the purse further includes means for alerting the user when the remote signal received by the purse has fallen below a certain strength. This indicates that the user has surpassed a certain distance from the purse. Further, in lieu of a purse, other totting devices such as bags and the like may be employed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A purse alarm comprising, in combination:

a flexible purse having a bottom face with a pair of side faces and a pair of end faces integrally coupled thereto and extending upwardly therefrom thus defining an interior space with an open top, the purse further including a pair of rigid hollow rods coupled along an upper edge of the side faces each with a pair of snaps situated thereon for allowing a selective closure of the open top and a handle assembly including a pair of inverted U-shaped straps each coupled to ends of an associated one of the end faces and a primary strap having ends slidably coupled to the inverted U-shaped straps;

a magnetic switch situated within the hollow rods for providing an activation signal upon a separation of the hollow rods and opening of the purse;

a purse alarm module situated within a housing which is in turn positioned in the interior space of the purse, the purse alarm module including:

a purse state means adapted to continuously transmit the activation signal upon the instantaneous receipt of the activation signal from the magnetic switch until the receipt of a clear signal, a delay means connected between the magnetic switch and the purse state means for transmitting the activation signal to the purse state means after a predetermined time from the receipt of the activation signal from the magnetic switch, a purse receiver means connected to the purse state means for relaying said clear signal upon the receipt of the clear signal via free space, a purse alarm means in communication with the purse state means and adapted to emit an audible alarm during the receipt of the activation signal, a discrete silent switch positioned on the housing of the purse alarm module and connected between the purse state means and the purse alarm means for selectively precluding the transmission of the activation signal to the purse alarm means for disabling the same, and a purse transmitter means connected to the purse state means for transmitting the activation signal via free space upon the receipt of the activation signal from the purse state means; and a portable remote module having a rectangular configuration with an eyelet formed on a periphery thereof for coupling with a key ring, the remote module including:

a remote receiver means adapted to receive the activation signal via free space, a remote alarm means for emitting an audible alarm during the receipt of the activation signal, a remote state means connected between the remote receiver means and the remote alarm means, the remote state means adapted to continuously transmit the activation signal to the remote alarm means upon the instantaneous receipt of the activation signal from the remote receiver means thereby actuating the remote alarm means upon the opening of the purse until the receipt of the clear signal, a reset button situated on the remote module and connected to the remote state means for transmitting the clear signal thereto upon the depression thereof thereby deactivating the remote alarm means, and a remote transmitter means connected to the reset button for transmitting the clear signal via free space upon the receipt of the clear signal thereby deactivating the purse alarm means.

2. A purse alarm comprising:

a purse;

a switch for providing an activation signal upon the opening of the purse;

a purse alarm module situated within the purse, the purse alarm module including:

a purse state mechanism in communication with the switch and adapted to continuously transmit the activation signal upon the instantaneous receipt of the activation signal, a purse alarm in communication with the purse state mechanism and adapted to emit an audible alarm during the receipt of the activation signal, a discrete silent switch connected between the purse state mechanism and the purse alarm for selectively precluding the transmission of the activation signal to the purse alarm for disabling the same, a purse receiver connected to the purse state mechanism for relaying a clear signal thereto upon the receipt of the clear signal via free space, wherein the purse state mechanism is adapted to cease the transmission of the activation signal upon receipt of said clear signal and a purse transmitter connected to the purse state mechanism for transmitting the activation signal via free space upon the receipt of the activation signal; and a portable remote including:

a remote receiver adapted to receive the activation signal via free space, a remote alarm for emitting an audible alarm during the receipt of the activation signal, a remote state mechanism connected between the remote receiver and the remote alarm, the remote state mechanism adapted to continuously transmit the activation signal to the remote alarm upon the instantaneous receipt of the activation signal from the remote receiver until the receipt of the clear signal thereby actuating the remote alarm upon the opening of the purse, a reset button situated the portable remote for generating the clear signal and transmitting the same to the remote state mechanism upon the depression thereof, and a remote transmitter connected to the reset button for transmitting the clear signal via free space upon the receipt of the clear signal thereby deactivating the purse alarm module.

3. A purse alarm as set forth in claim 2 wherein the purse has a bottom face with a pair of side faces and a pair of end faces integrally coupled thereto and extending upwardly therefrom thus defining an interior space with an open top, the purse further including a handle assembly.

4. A purse alarm as set forth in claim 2 wherein the switch includes a magnetic switch.

5. A purse alarm as set forth in claim 2 wherein the purse alarm module includes a delay mechanism connected between the switch and the purse state mechanism for transmitting the activation signal to the purse state mechanism after a predetermined time from the receipt of the activation signal from the switch.

* * * * *